United States Patent [19]

Rioja et al.

[11] Patent Number: 4,832,910

[45] Date of Patent: May 23, 1989

[54] ALUMINUM-LITHIUM ALLOYS

[75] Inventors: Roberto J. Rioja, Lower Burrell; Philip E. Bretz, Pittsburgh; John E. Jacoby, Murrysville, all of Pa.

[73] Assignee: Aluminum Company of America, Pittsburgh, Pa.

[21] Appl. No.: 812,386

[22] Filed: Dec. 23, 1985

[51] Int. Cl.[4] ..... C22C 21/00

[52] U.S. Cl. ..... 420/528; 420/529; 420/531; 420/532; 420/533; 420/534; 420/535; 420/540; 420/541; 420/542

[58] Field of Search ..... 420/528, 529, 531, 532, 420/533-535, 540-542; 148/415-418, 437-440

[56] References Cited

U.S. PATENT DOCUMENTS 3,795,505 3/1974 Corradini ..... 75/53

FOREIGN PATENT DOCUMENTS 1521857 3/1968 France .
61-133358 6/1986 Japan .
331110 3/1972 U.S.S.R. .

OTHER PUBLICATIONS

"Microstructure and Toughness of High-Strength Aluminum Alloys", J. T. Staley, *Properties Related to Fracture Toughness*, ASTM STP 605, American Society for Testing and Materials, 1976, pp. 71-103.

"Development of the Short Rod Method of Fracture Toughness Measurement", L. M. Barker, presented at the ASM Conference on Wear and Fracture Prevention, Peoria, Ill., May 21-22, 1980, pp. 1-30.

"Comparisons of Fracture Toughness Measurements by the Short Rod and ASTM Standard Method of Test for Plane-Strain Fracture Toughness of Metallic Materials (E 399-78)", L. M. Barker & F. I. Baratta, *Journal of Testing and Evaluation*, JTEVA, vol. 8, No. 3, May 1980, pp. 97-102.

"Oxidation of Aluminum-Lithium Alloys and Methods of Protection", L. V. Kuz'michev, L. Ya. Maizlin, A. Ya. Radin & B. D. Guryeyev, pp. 1-8.

*Primary Examiner*—R. Dean
*Attorney, Agent, or Firm*—Douglas G. Glantz

[57] ABSTRACT

Disclosed is an aluminum-lithium alloy containing a predetermined amount of lanthanides which provides the alloy with an improved combination of strength and fracture toughness relative to a baseline alloy not containing lanthanides but otherwise having the alloy's composition.

11 Claims, 4 Drawing Sheets

ALUMINUM-LITHIUM ALLOYS

BACKGROUND OF THE INVENTION

This invention relates to aluminum base alloys, and more particularly, to improved lithium containing aluminum base alloys.

The aircraft industry has recognized that one of the most effective ways to reduce the weight of an aircraft is to reduce the density of the aluminum alloys used in the aircraft. To accomplish such, lithium has been added to the alloys. However, the addition of lithium has not been without problems. For example, lithium often results in a decrease in ductility and fracture toughness which can make the alloy unsuitable for certain aircraft applications.

The aircraft industry has also recognized that both high strength and high fracture toughness are quite difficult to achieve even in conventional aircraft alloys such as AA (aluminum Association) 2024-T3X and 7050-TX. For example, a paper by J. T. Staley entitled "Microstructure and Toughness of High-Strength Aluminum Alloys", Properties Related to Fracture Toughness, ASTM STP605, American Society for Testing and Materials, 1976, pp. 71-103, reports generally that toughness decreases as strength increases in AA 2024 sheet and AA 7050 plate. Accordingly, it would be desirable if both strength and fracture toughness could be improved in aircraft alloys, particularly in the lighter aluminum-lithium alloys having density reductions of 5 to 15%. Such alloys would find widespread use in the aerospace industry where low weight, high strength and toughness would provide significant fuel savings.

SUMMARY OF THE INVENTION

A principal object of this invention is to provide an improved lithium containing aluminum base alloy.

Another object of this invention is to provide an improved aluminum-lithium base alloy having improved strength and toughness characteristics.

These and other objects will become apparent from the specification, drawings and claims appended hereto.

In accordance with these objects, an aluminum base alloy having improved strength and fracture toughness characteristics is provided. The improved aluminum alloy contains between 0.5 and 5.0 wt.% Li and less than 0.3 wt.% lanthanides. Lanthanide content is predetermined or controlled to provide the alloy with an improved combination of strength and fracture toughness relative to a baseline alloy not containing lanthanides but otherwise having the alloy's composition. A preferred aluminum base alloy contains from 0.5 to 5.0 wt.% Li, 0.01 to less than 0.3 wt.% lanthanides, 0 to 5.0 wt.% Mg, 0 to 5.0 wt.% Cu, 0 to 1.0 wt.% Zr, 0 to 2.0 wt.% Mn, 0 to 7.0 wt.% Zn, 0.5 wt.% max. Fe and 0.5 wt.% max. Si. Again, lanthanide content is predetermined or controlled to provide the alloy with an improved combination of strength and toughness relative to a baseline alloy not containing lanthanides but otherwise having said alloy's composition.

DETAILED DESCRIPTION OF THE PREFERRED EMBODIMENTS

Figure 1:
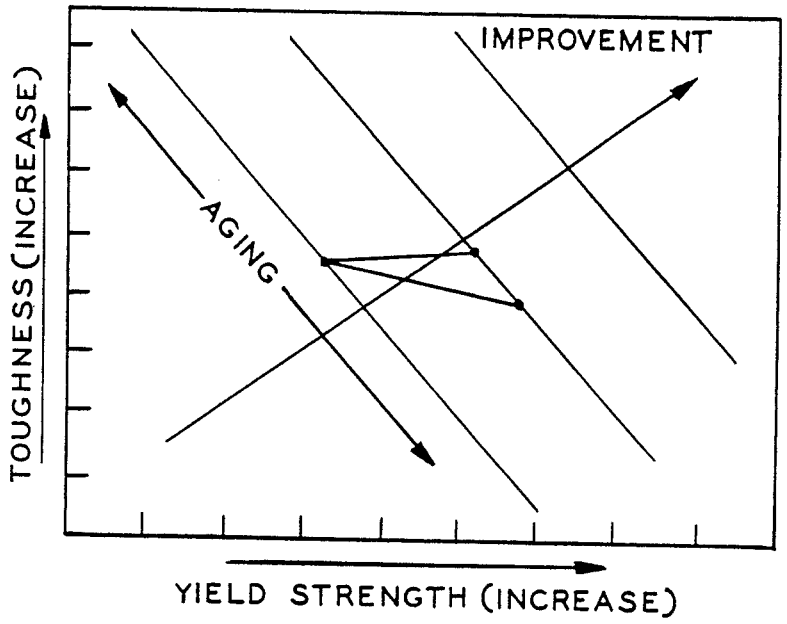
FIG. 1 illustrates different toughness/yield strength relationship where shifts in the upward direction and to the right represent improved combinations of these properties.

The alloy of the present invention is an aluminum base alloy containing from 0.5 to 5.0 wt.% Li and less than 0.3 wt.% lanthanides. The amount of lanthanides is predetermined or controlled to provide the alloy with an improved combination of strength and fracture toughness relative to a baseline alloy not containing lanthanides but otherwise having the alloy's composition.

A more preferred alloy in accordance with the present invention is an aluminum base alloy containing from 1.0 to 4.0 wt.% Li, 0.01 to less than 0.2 wt.% lanthanides, 0 to 5.0 wt.% Mg, 0.1 to 5.0 wt.% Cu, 0 to 1.0 wt.% Zr, 0 to 2.0 wt.% Mn, 0 to 7.0 wt.% Zn, 0.5 wt.% max. Fe and 0.5 wt.% max. Si, the balance being primarily aluminum. Again, the lanthanides are provided in an amount effective to provide the alloy with an improved combination of strength and fracture toughness relative to a baseline alloy not containing lanthanides but otherwise having the alloy's composition. A typical alloy composition would contain 2.0 to 3.0 wt.% Li, 0.01 to 0.12 wt.% lanthanides, 0.5 to 4.0 wt.% Cu, 0 to 3.0 wt.% Mg, 0 to 0.2 wt.% Zr, 0 to 1.0 wt.% Mn and max. 0.1 wt.% each of Fe and Si.

Lithium is an essential element of the alloy of the present invention since it provides the alloy with decreased density, improved tensile and yield strengths, and an improved modulus of elasticity. Lithium is preferably provided in amounts greater than or equal to 0.5 wt.% since lesser amounts will not significantly reduce the alloy's density. Lithium's upper limit should generally not exceed 5 wt.% since greater amounts will usually exceed the alloy's solubility limit. Undissolved lithium is undesirable because it generally forms constituent phases that are detrimental to the toughness and the corrosion behavior of the material.

The presence of copper in the aforementioned range may be desirable in some situations since it minimizes fracture toughness losses which may be associated with the presence of lithium. However, excessive copper (i.e., above 7 wt.%) should be avoided since it may result in the formation of undesirable intermetallics which can reduce fracture toughness.

Magnesium is also desirable in some situations since it increases alloy strength and decreases density slightly. The upper limits set forth above should be adhered to, however, since excess manganese can reduce fracture toughness due to the formation of undesirable phase at the grain boundaries.

Manganese and zinc may also be added for controlling grain structure. In addition, manganese acts as a strengthening agent by virtue of its tendency with thermal treatments to form or precipitate small particle dispersoids such as $Al_{20}Cu_2Mn_3$ and $Al_{12}Mg_2Mn$. Zinc can also increase alloy strength, particularly when combined with magnesium. However, excessive amounts of zinc should be avoided since such can impair toughness through the formation of undesirable intermetallic phases. Chromium can also be used for grain structure control but on a less preferred basis.

Toughness of fracture toughness as used herein refers to the resistance of a body, e.g. sheet or plate, to the unstable growth of cracks or other flaws.

An improved combination of strength and toughness within the meaning of the present invention represents a shift in the normal inverse relationship between strength and toughness. That is, an improved combination of strength and toughness will have either greater toughness at a given level of strength or greater strength at a given level of toughness. For example, in FIG. 1, going from point A to point D represents the loss in toughness usually associated with increasing the strength of an alloy. In contrast, going from point A to point B results in an increase in strength at the same toughness level. Thus, point B has an improved combination of strength and toughness relative to point A. Also, while toughness decreases slightly in going from point A to point C, strength is greatly increased. Thus, even though toughness is slightly less than that at point A, it is significantly higher than that at point D. Thus, relative to point A, the combination of strength and toughness at point C is considerably improved.

In accordance with the present invention, the addition of small amounts of elements from the lanthanide series has been found to increase the aforementioned strength/toughness combination in aluminum/lithium base alloys of the type discussed above. The lanthanides as used herein comprise a group of 15 rare earth elements between barium and hafnium in group IIIA of the Periodic Table. One commercially available form of lanthanide elements is Misch metal or mixed metal. Mixed metal typically contains about 50 wt.% cerium, 25 wt.% lanthanum, about 10 wt.% neodymium and from 1 to 5 wt.% other elements from the series.

Tables 1, 2 and 3 set forth, respectively, the compositions of three series of lanthanide containing Al-Li alloys which were made for laboratory evaluation. In each series, the lanthanides were added as either pure cerium (Ce) or Ce-free Misch metal (MM), a mixture of lanthanides (atomic numbers 57 and 59–71) consisting principally of lanthanum (La=36 wt.%). All alloys were cast into an ingot suitable for rolling. The ingot was then homogenized in a furnace at a temperature of 1000° F. for 24 hours and then hot rolled into a plate product about one inch thick. The plate was then solution heated treated in a heat treating furnace at a temperature of 1020° F. for one hour and then quenched by immersion in 70° F. water, the temperature of the plate immediately before immersion being 1020° F. Thereafter, a sample of the plate was stretched 2% greater than its original length. The stretched samples were then artificially aged by heat treating at 325° F. for lengths of time up to 24 hours. The yield strength values for the samples referred to are based on specimens taken in the longitudinal direction, the direction parallel to the direction of rolling, and in the short transverse direction. Yield strength in the tests was determined by ASTM Standard Method E8. Toughness in the longitudinal direction in the tests was determined by ASTM Standard Method E399. Toughness in the short transverse direction was measured by the short rod method test which is described in two papers. The first paper is entitled "Development of the Short Rod Method of Fracture Toughness Measurement" and authored by L. M. Barker. This paper was presented at the ASM Conference on Wear and Fracture Prevention, Peoria, Ill. on May 21–22, 1980. The second paper describing the short rod test is entitled "Comparisons of Fracture Toughness Measurements by the Short Rod and ASTM Standard Method of Test for Plane-Strain Fracture Toughness of Metallic Materials (E 399-78)", by L. M. Barker and F. I. Baratta, *Journal of Testing and Evaluation,* Vol. 8, No. 3, May 1980, pp. 97–102.

Figure 2:
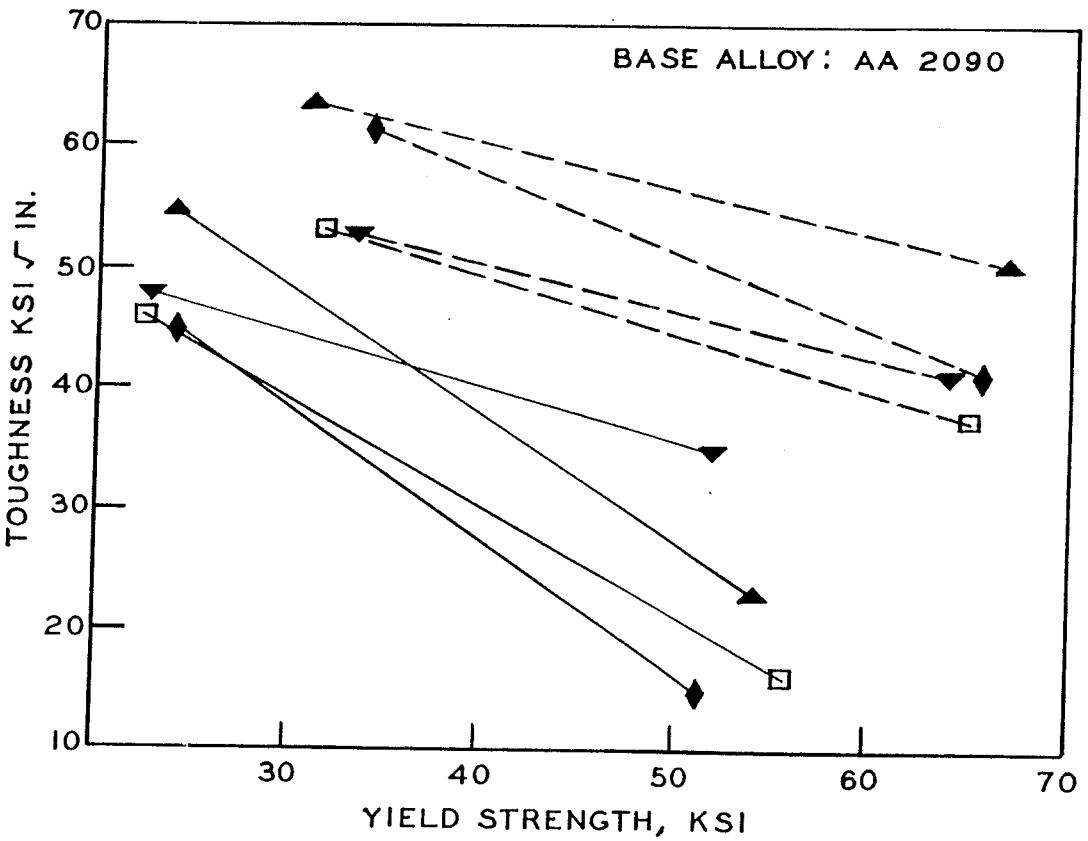
FIG. 2 is a graph illustrating various toughness/yield strength values in both the long transverse and short transverse orientations for an AA 2090 series of alloys containing different amounts and combinations of lanthanide elements.

Toughness/strength data for the first series of alloys (i.e., Table 1 alloys) having a nominal AA 2090 composition are plotted in FIG. 2. The results show that in both the longitudinal and short transverse orientations, lanthanide containing alloys B, C and D having a higher toughness/strength combination than baseline alloy A. Overall, the best alloy is alloy B containing 0.02 wt.% Ce which recorded a 30% increase in toughness relative to the baseline alloy A.

Figure 3:
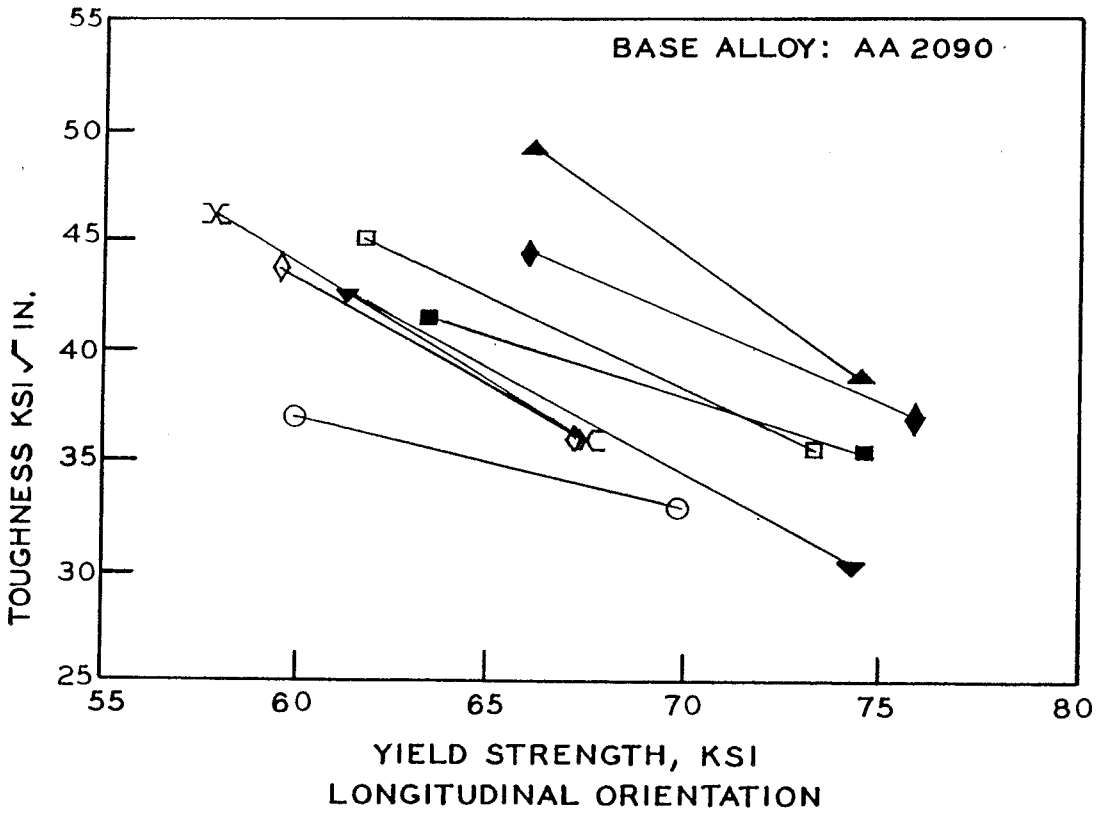
FIG. 3 is a graph illustrating various toughness/yield strength values in the long transverse orientation for another series of AA 2090 alloys containing different amounts and combinations of lanthanide elements.

The Series 2 alloys described in Table II (also nominally of 2090 composition) have a more extensive range of lanthanide additions than those of Series 1. Longitudinal toughness/strength data for these alloys are plotted in FIG. 3. The best performer in this group showing a 25% increase in toughness was alloy C containing 0.025 wt.% Ce-free MM. Alloy E containing 0.015 wt.% Ce plus 0.015 wt.% Ce-free MM also recorded an increase in toughness relative to baseline alloy A. The other alloys (i.e., alloys F, G, H, I and J) generally showed losses in toughness. While it is not understood why these alloys suffered losses in toughness, it will be noted that these alloys have higher lanthanide contents than alloys C and E and also alloys B, C and D of Table 1, also of nominal AA 2090 composition. Higher lanthanide content may be detrimental in AA 2090 alloy because of the formation of constituent phases. Alloy samples B and D in this series are not plotted in FIG. 3 because they cracked during hot rolling.

Figure 4:
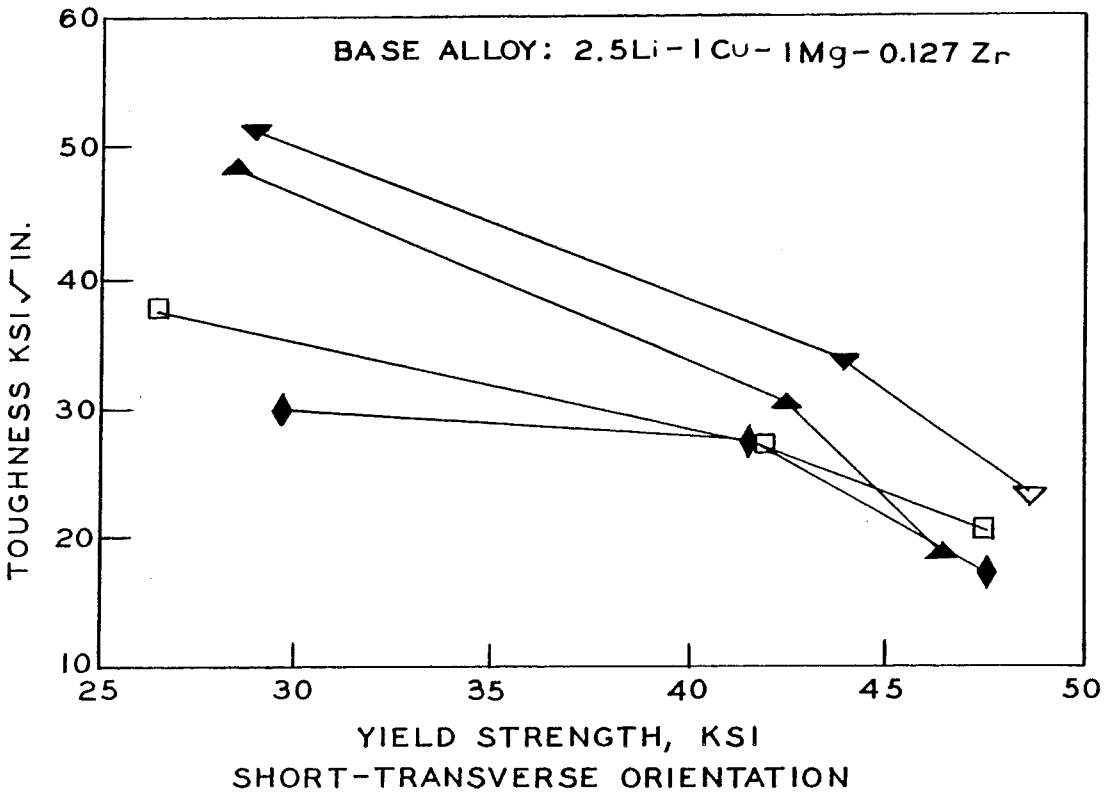
FIG. 4 is a graph illustrating various toughness/yield strength values in the short transverse orientation for another series of aluminum-lithium alloys having a base composition of 2.5 wt.% Li, 1.0 wt.% Cu, 1.0 wt.% Mg and 0.12 wt.% Zr, but containing different amounts and combinations of lanthanide elements.

FIG. 4 sets forth results in the short transverse orientation for the third series of alloys tested which had a baseline composition of 2.5 wt.% Li, 1.0 wt.% Cu, 1.0 wt.% Mg and 0.12 wt.% Zr. The best performer in this series was alloy D containing 0.02 wt.% Ce-free MM. Alloy B, with 0.013 wt.% Ce/0.013 wt.% Ce-free MM, also did well.

Accordingly, those skilled in the relevant art will appreciate that aluminum-lithium base alloys having improved combinations of strength and fracture toughness can be provided in accordance with the present invention by adding small amounts of elements from the lanthanide series to the baseline alloy. The precise amount to be added to a particular alloy to optimize the toughness/strength combination will have to be empirically predetermined for each alloy; however, those skilled in the relevant art having read the instant specification should be able to determine such without engaging in undo experimentation.

TABLE 1

| Sample | Li | Cu | Zr | Ce | Ce-Free MM | Total Lanthanide Content |
|---|---|---|---|---|---|---|
| A | 2.2 | 2.7 | 0.12 | — | — | — |
| B | 2.2 | 2.7 | 0.12 | 0.02 | — | 0.02 |
| C | 2.2 | 2.7 | 0.12 | 0.02 | 0.02 | 0.04 |

TABLE 1-continued

| Sample | Li | Cu | Zr | Ce | Ce-Free MM | Total Lanthanide Content |
|---|---|---|---|---|---|---|
| D | 2.2 | 2.7 | 0.12 | 0.1 | 0.02 | 0.12 |

TABLE 2

| Sample | Li | Cu | Zr | Ce | Ce-Free MM | Total Lanthanide Content |
|---|---|---|---|---|---|---|
| A | 2.2 | 2.7 | 0.12 | — | — | — |
| B | 2.2 | 2.7 | 0.12 | 0.025 | — | 0.025 |
| C | 2.2 | 2.7 | 0.12 | — | 0.025 | 0.025 |
| D | 2.2 | 2.7 | 0.12 | 0.005 | 0.005 | 0.010 |
| E | 2.2 | 2.7 | 0.12 | 0.013 | 0.013 | 0.026 |
| F | 2.2 | 2.7 | 0.12 | 0.025 | 0.025 | 0.050 |
| G | 2.2 | 2.7 | 0.12 | 0.050 | 0.050 | 0.100 |
| H | 2.2 | 2.7 | 0.12 | 0.10 | 0 | 0.10 |
| I | 2.2 | 2.7 | 0.12 | 0 | 0.10 | 0.10 |
| J | 2.2 | 2.7 | 0.12 | 0.10 | 0.10 | 0.20 |

TABLE 3

| Sample | Li | Cu | Mg | Zr | Ce | Ce-Free MM | Total Lanthanide Content |
|---|---|---|---|---|---|---|---|
| A | 2.5 | 1 | 1 | 0.12 | — | — | — |
| B | 2.5 | 1 | 1 | 0.12 | 0.013 | 0.013 | 0.026 |
| C | 2.5 | 1 | 1 | 0.12 | 0.025 | — | 0.025 |
| D | 2.5 | 1 | 1 | 0.12 | — | 0.02 | 0.02 |

While the invention has been described in terms of preferred embodiments, the claims appended hereto are intended to encompass all embodiments which fall within the spirit of the invention.

What is claimed is:

1. An aluminum base alloy consisting essentially of 0.5 to 5.0 wt.% Li and less than 0.3 wt.% lanthanides, said lanthanides being present in an amount effective to provide said alloy with an improved combination of strength and fracture toughness relative to a baseline alloy not containing lanthanides but otherwise having said alloy's composition.

2. An alloy as recited in claim 1 wherein the lanthanide content is from 0.01 to 0.2 wt.%.

3. An alloy as recited in claim 1 wherein the lanthanide content is from 0.01 to 0.12 wt.%.

4. An alloy as recited in claim 1 wherein the lanthanide content is from 0.01 to 0.05 wt.%.

5. An aluminum base alloy consisting essentially of from 0.5 to 5.0 wt.% Li, 0.01 to less than 0.3 wt.% lanthanides, 0 to 5.0 wt.% Mg, 0 to 5.0 wt.% Cu, 0 to 1.0 wt.% Zr, 0 to 2.0 wt.% Mn, 0 to 7.0 wt.% Zn, 0.5 wt.% max. Fe and 0.5 wt.% max. Si, said lanthanides being present in an amount effective to provide said alloy with an improved combination of strength and fracture toughness relative to a baseline alloy not containing lanthanides but otherwise having said alloy's composition.

6. An alloy as recited in claim 5 wherein the lithium content is from 1.0 to 4.0 wt.%.

7. An alloy as recited in claim 5 wherein the lithium content is from 2.0 to 3.0 wt.%.

8. An alloy as recited in claim 5 wherein the copper content is from 0.1 to 5.0 wt.%.

9. An alloy as recited in claim 5 wherein the copper content is from 0.5 to 4.0 wt.%.

10. An alloy as recited in claim 5 wherein iron and silicon contain a maximum of 0.1 wt.% each.

11. An alloy as recited in claim 5 containing 2.0 to 3.0 wt.% lithium, 0.01 to 0.12 wt.% lanthanides, 0.5 to 4.0 wt.% copper, 0 to 3.0 wt.% magnesium, 0 to 0.2 wt.% zirconium, 0 to 1.0 wt. manganese, and max. 0 to 0.1 wt.% each of iron and silicon.

* * * * *